US008931464B2

(12) United States Patent
Jackson

(10) Patent No.: US 8,931,464 B2
(45) Date of Patent: Jan. 13, 2015

(54) CUSTOM RECURVE BOW

(75) Inventor: John Jackson, Waterloo, IN (US)

(73) Assignee: Deerspace LLC, Waterloo, IN (US)

( * ) Notice: Subject to any disclaimer, the term of this patent is extended or adjusted under 35 U.S.C. 154(b) by 190 days.

(21) Appl. No.: 13/345,111

(22) Filed: Jan. 6, 2012

(65) Prior Publication Data

US 2012/0174902 A1 Jul. 12, 2012

Related U.S. Application Data

(60) Provisional application No. 61/430,257, filed on Jan. 6, 2011.

(51) Int. Cl.
*F41B 5/00* (2006.01)
*F41B 5/14* (2006.01)

(52) U.S. Cl.
CPC ..... *F41B 5/1403* (2013.01)
USPC ..... 124/23.1

(58) Field of Classification Search
USPC ..... 124/23.1, 25.6, 86, 88
See application file for complete search history.

(56) References Cited

U.S. PATENT DOCUMENTS

| | | | | |
|---|---|---|---|---|
| 2,370,783 | A * | 3/1945 | Dritz | 124/24.1 |
| 5,005,554 | A * | 4/1991 | Shepley et al. | 124/24.1 |
| 5,123,396 | A * | 6/1992 | Shepley et al. | 124/25.5 |
| 5,706,794 | A * | 1/1998 | Neal | 124/25.6 |
| 7,258,113 | B2 | 8/2007 | Pilpel et al. | |
| 7,299,798 | B2 | 11/2007 | Flanagan | |
| 7,334,575 | B2 | 2/2008 | McPherson | |
| 7,438,070 | B2 | 10/2008 | Mancini | |
| 7,574,811 | B2 | 8/2009 | Kurtzhals et al. | |
| 7,708,000 | B2 | 5/2010 | Mancini | |
| 8,079,353 | B2 | 12/2011 | Davis et al. | |
| 8,136,514 | B2 | 3/2012 | Howard et al. | |
| 2009/0032002 | A1 | 2/2009 | Howard et al. | |
| 2009/0050125 | A1 | 2/2009 | Davis et al. | |
| 2011/0220085 | A1 | 9/2011 | Christensen et al. | |
| 2011/0253120 | A1 | 10/2011 | Robertson | |
| 2011/0259309 | A1 | 10/2011 | Oppenheim | |
| 2011/0303203 | A1 | 12/2011 | Jolley et al. | |
| 2012/0174902 | A1 | 7/2012 | Jackson | |
| 2012/0192843 | A1 | 8/2012 | Batdorf | |

* cited by examiner

*Primary Examiner* — John Ricci

(74) *Attorney, Agent, or Firm* — McConnell IP Law

(57) ABSTRACT

A riser for a bow is disclosed that includes a body having a central portion, an upper portion, and a lower portion. The central portion includes a grip portion and an arrow rest. The upper portion and lower portion of the body include at least one aperture. A custom image is either integrally formed within at least one of the apertures or a frame containing a custom image is removably secured in at least one of the apertures.

12 Claims, 3 Drawing Sheets

CUSTOM RECURVE BOW

CROSS REFERENCE TO RELATED APPLICATION

The present application claims priority to and the benefit of U.S. provisional application No. 61/430,257 filed on Jan. 6, 2012, which is hereby incorporated by reference in its entirety.

BACKGROUND OF THE INVENTION

1. Technical Field

The present invention relates generally to bows and more particularly, to a custom recurve bow having a custom image formed in an aperture of the bow frame.

2. Related Art

A recurve bow has tips that curve away from the archer when the bow is strung. The difference between recurve and other bows is that the string touches a section of the limb when the bow is strung. A recurve bow stores more energy and delivers energy more efficiently than an equivalent straight-limbed bow. Recurve limbs also put greater strain on the materials used to make the bow and make more noise when shot.

SUMMARY

A bow is disclosed that includes a riser and limbs. The riser includes at least one aperture or cutout. In one form, a custom image is integrally formed within the aperture, such as a deer for example. In other forms, a frame is removably secured within the aperture. This allows the owner to change between different images.

DETAILED DESCRIPTION

Figure 1:
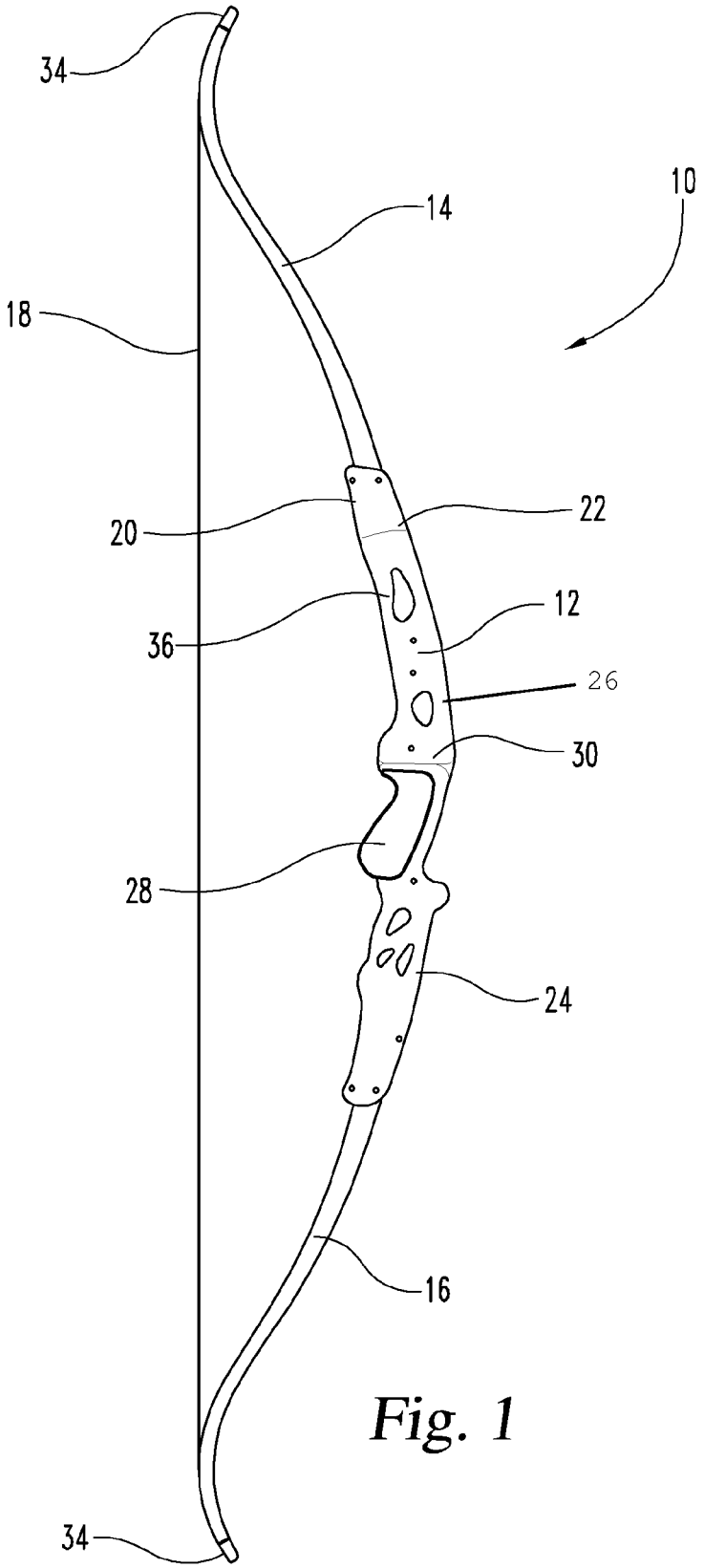
FIG. 1 illustrates a representative recurve bow.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any such alterations and further modifications in the illustrated device, and any such further applications of the principles of the invention as illustrated therein being contemplated as would normally occur to one skilled in the art to which the invention relates.

Referring to FIG. 1, a recurve bow 10 is illustrated that includes a riser 12, an upper limb 14, a lower limb 16, and a string 18. The riser 12 is the rigid center section of the bow 10 to which the limbs 14, 16 are removably attached. The upper limb 14 is connected to an upper portion 20 of the riser 12 by one or more securing devices 22 in one representative form. The lower limb 16 is connected to a lower portion 24 of the riser 12 by one or more securing devices 22. Although screws are used in the illustrative form, it should be appreciated that other types of connection devices could be used in other forms such as nuts and bolts, an interlocking mechanism, by a friction fit, and so forth.

An intermediate portion 26 of the riser 12 includes a grip 28 and an arrow rest 30. The grip 28 is the part of the bow 10 held by the bow hand of the shooter. The arrow rest 30 is the portion of the bow 10 where the arrow rests during draw. Although a simple fixed rest is illustrated, it should be appreciated that other types of rests may be used such as spring-loaded or magnetic flip rests for example. As illustrated, a string 18 is attached to both limb tips 34 and transforms stored energy from the limbs 14, 16 into kinetic energy in the arrow. The riser 12 may also include one or more apertures 36 located in either the upper or lower portion 20, 24 of the riser 12. The apertures 36 allow the riser to be lighter in weight as well as providing somewhat of an aesthetic appearance.

Figure 2:
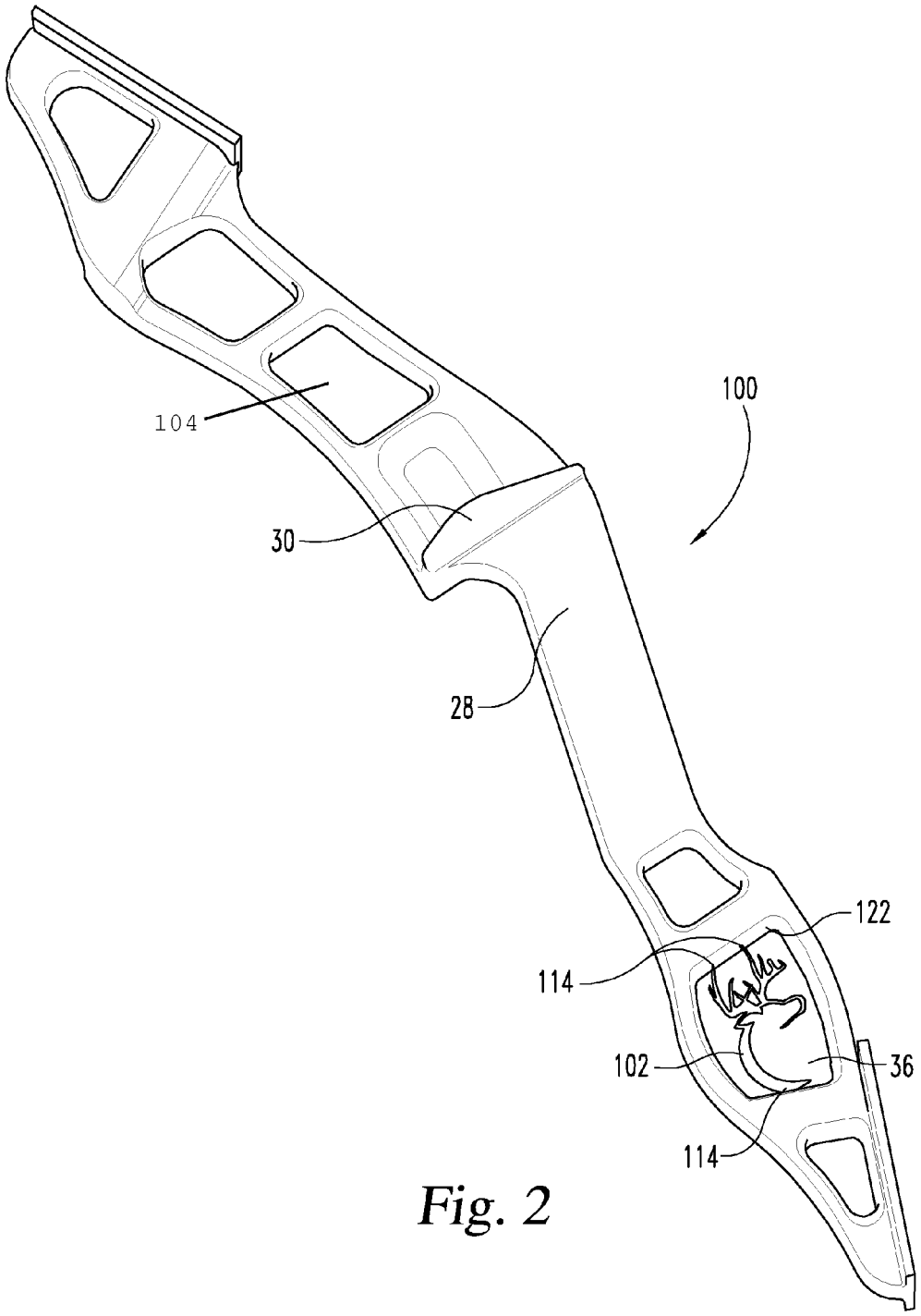
FIG. 2 illustrates a representative riser.

Referring to FIG. 2, the present invention discloses a custom riser 100 that includes a two-dimensional or three-dimensional image 102 that is integrally formed in one or more of a plurality of apertures 104 located in the riser 100. The image 102 may be a predetermined image or an image selected by the customer. In the illustrated form, the customer has uploaded an image of a deer to be integrally manufactured as part of the riser 100. The owner of the present invention is then able to machine or manufacture the riser 100 in a custom manner defined by the customer. As such, in one form of the present invention every customer can truly have a custom bow with an image of their choosing formed in the riser 100.

The logo, image, or shape 102 may be integrated into the riser 100 by using the one of the following manufacturing techniques: wire electrical discharge machining (EDM), extrusion, casting, water jet, laser, or other process so that the riser and image 102 are all one piece, or the image 102 may be a separate piece that may be attached by various methods. As illustrated in FIG. 2, in this form the riser 100 contains an integrally formed custom image 102. The custom image 102 is connected to an interior surface 112 at one or more connection points 114.

Figure 3:
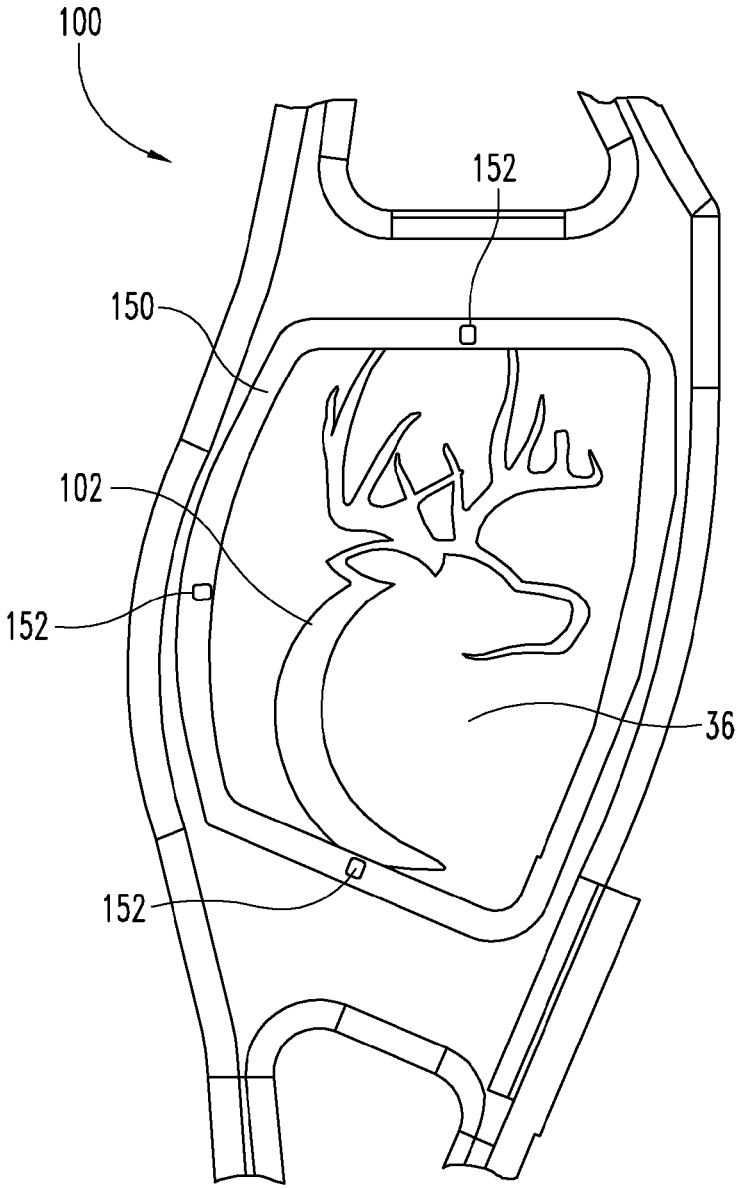
FIG. 3 illustrates a portion of the riser illustrated in FIG. 2.

Referring to FIG. 3, a portion of another custom riser 100 is illustrated wherein the custom image 102 is housed within a frame or housing 150. As illustrated, the frame 150 has been inserted into the aperture 36 defined in the body of the riser 100. The frame 150 can be secured in the aperture 36 by one or more securing devices 152 or by other means such as a friction fit. In this form, the user of the bow is provided with a means for interchanging custom images 102 from their bow. The custom riser 100 allows multiple frames 150 to be inserted into the aperture 36 thereby allowing a plurality of custom images 102 to be utilized.

While the invention has been illustrated and described in detail in the drawings and foregoing description, the same is to be considered as illustrative and not restrictive in character, and that all changes and modifications that come within the spirit of the invention are desired to be protected.

What is claimed is:

1. A riser for a bow, comprising:

a body having a central portion, an upper portion, and a lower portion, wherein said central portion includes a grip portion and an arrow rest, wherein said upper portion and said lower portion include at least one aperture; and a custom image integrally formed within said body in at least one of said apertures.

2. The riser of claim 1, wherein said custom image comprises a wire discharge machining image.

3. The riser of claim 1, wherein said custom image comprises an extrusion process image.

4. The riser of claim 1, wherein said custom image comprises a casting image.

5. The riser of claim 1, wherein said custom image comprises a water jet image.

6. The riser of claim 1, wherein said custom image comprises a laser image.

7. The riser of claim 1, wherein said custom image comprises a two-dimensional custom image.

8. The riser of claim 1, wherein said custom image comprises a three-dimensional custom image.

9. A bow, comprising:

a body having a central portion, an upper portion, and a lower portion, wherein said central portion includes a grip portion, wherein a portion of said body includes at least one aperture;

an upper limb connected to an upper end of said upper portion of said body;

a lower limb connected to a lower end of said lower portion of said body;

a string having a first end connected with a first limb tip of said upper limb and a second end connected with a second limb tip of said lower limb; and a custom image integrally formed in said at least one aperture in said body.

10. The bow of claim 9, wherein said custom image comprises a deer.

11. The bow of claim 9, wherein said custom image comprises a two-dimensional custom image.

12. The bow of claim 9, wherein said custom image comprises a three-dimensional custom image.

* * * * *